US010245469B2

(12) United States Patent
Aoyama et al.

(10) Patent No.: US 10,245,469 B2
(45) **Date of Patent: *Apr. 2, 2019**

(54) GOLF BALL AERODYNAMIC CONFIGURATION

(71) Applicant: Acushnet Company, Fairhaven, MA (US)

(72) Inventors: Steven Aoyama, Marion, MA (US); Traci L. Olson, Westport, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/945,759

(22) Filed: Apr. 5, 2018

(65) Prior Publication Data

US 2018/0221715 A1 Aug. 9, 2018

Related U.S. Application Data

(63) Continuation of application No. 15/215,624, filed on Jul. 21, 2016, now Pat. No. 9,956,454, which is a continuation of application No. 14/135,618, filed on Dec. 20, 2013, now Pat. No. 9,403,063.

(51) Int. Cl.
*A63B 37/06* (2006.01)
*A63B 37/00* (2006.01)

(52) U.S. Cl.
CPC ..... *A63B 37/0015* (2013.01); *A63B 37/001* (2013.01); *A63B 37/0006* (2013.01); *A63B 37/0008* (2013.01); *A63B 37/0009* (2013.01); *A63B 37/0012* (2013.01); *A63B 37/0018* (2013.01); *A63B 37/0021* (2013.01); *A63B 37/0007* (2013.01)

(58) Field of Classification Search
CPC ..... A63B 37/001; A63B 37/0004
USPC ..... 473/382
See application file for complete search history.

(56) References Cited

U.S. PATENT DOCUMENTS

| | | | | |
|---|---|---|---|---|
| 1,681,167 | A | 8/1928 | George | |
| 5,916,044 | A | 6/1999 | Shimosaka et al. | |
| 5,957,787 | A | 9/1999 | Hwang | |
| 6,139,448 | A | 10/2000 | Sullivan | |
| 6,626,772 | B1 | 9/2003 | Kennedy, III | |
| 6,971,962 | B2 | 12/2005 | Kasashima et al. | |
| 7,033,285 | B2 | 4/2006 | Sato et al. | |
| 7,041,013 | B2 | 5/2006 | Ohama et al. | |
| 7,160,212 | B2 | 1/2007 | Sato et al. | |
| 7,241,233 | B2 | 7/2007 | Sato | |
| 7,250,011 | B2 | 7/2007 | Simonds et al. | |
| 7,250,012 | B1 | 7/2007 | Simonds et al. | |
| 7,476,163 | B2 | 1/2009 | Kasahima | |
| 9,956,454 | B2 * | 5/2018 | Aoyama | A63B 37/0015 |

* cited by examiner

*Primary Examiner* — Raeann Gorden
(74) *Attorney, Agent, or Firm* — Kristin D. Wheeler

(57) ABSTRACT

The present invention relates to golf balls, specifically to a golf ball comprising an aerodynamic pattern having novel shaped dimple structures which reduce the variation in airflow turning angle thereby improving the golf ball's flight performance. The dimple structures have a conical shaped base with a dimple in the center and reduced or no flat land areas between the dimples.

11 Claims, 12 Drawing Sheets

Section 2B-2B

Section 2B-2B

Section 4B-4B

Section 5B-5B

Section 6B-6B

Section 7B-7B

Section 8B-8B

Section 9B-9B

Section 10B-10B

Section 11B-11B

GOLF BALL AERODYNAMIC CONFIGURATION

CROSS-REFERENCE TO RELATED APPLICATIONS

This application is a continuation of co-pending, co-assigned U.S. patent application Ser. No. 15/215,624 filed on Nov. 24, 2016, which is a continuation of U.S. patent application Ser. No. 14/135,618 filed on Dec. 20, 2013, the entire disclosures of which are hereby incorporated by reference.

FIELD OF THE INVENTION

The present invention relates to golf balls, and more particularly, to golf balls having modified dimple structures that reduce turn angle and aerodynamic drag.

BACKGROUND OF THE INVENTION

The golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through air.

When a golf ball travels through the air, the air surrounding the ball has different velocities relative to the ball and, thus, different pressures. The air develops a thin boundary layer adjacent to the ball's outer surface. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. Golf ball dimples having a conventional circular shape have been demonstrated through decades of use to produce aerodynamic characteristics that are as good as or better than other shapes such as polygons. This is believed to result from the radial symmetry of a circle, which presents the same geometric shape to the airflow regardless of the incoming direction, as well as the fact that circles don't have corners to cause airflow disruptions.

A disadvantage of circular dimples is that they cannot be tessellated or tiled on the surface of a ball with narrow uniform gaps. Even with ideal packing, there will still remain triangular pieces of land area where three dimples come together. Among other things, this causes inconsistent turning angles of the airflow entering the dimples. For example, as shown in FIG. 1A, air that is traveling across a piece of land before entering a dimple will encounter a turn angle approximately equal to the dimple's edge angle. On the other hand, as shown in FIG. 1B, at a point where two dimples touch or nearly touch, the air will be rising out of one dimple and turning directly down into the other, resulting in a turn angle of approximately twice the dimples' edge angle. Since turn angle affects the character of the flow, especially in terms of boundary layer separation and turbulence generation, both critical for golf balls, this situation is less than optimal since both conditions cannot be made ideal at the same time.

Based on the significant role that dimples play in golf ball design, manufacturers continually seek to develop novel dimple patterns, sizes, shapes, volumes, cross-sections, etc. Thus, there exists a need for an improved dimple configuration that provides more optimal airflow conditions.

SUMMARY OF THE INVENTION

The present invention comprises a golf ball comprising a plurality of dimple structures in which each dimple is surrounded by a conical slope with little or no flat land area. The incoming airflow sees the same turn angle regardless of the proximity of neighboring dimple. This creates an overall more optimal flow condition.

In one embodiment, the more consistent turn angle may be achieved using a smaller dimple edge angle, which may reduce aerodynamic drag In one embodiment according to the present invention, a golf ball is provided having an outer surface, the outer surface comprising a plurality of dimple structures, each dimple structure having an annular conical shaped base having a center with a dimple formed therein. Preferably, the outer surface of the golf ball has from 90 to 400 dimple structures. In another embodiment, at least one valley is formed by the conical shaped bases of adjacent dimples. In yet another embodiment, the at least one conical shaped base has a wall angle $\alpha$ of 15° to 25°. A plan shape of said dimple structures may be circular, elliptical, egg-shaped, rounded polygonal, faceted, or oval. In another embodiment, a cross-sectional shape of the dimple may be a circular arc, parabolic, elliptical, catenary, V shaped, truncated V shaped, or compound arc, or configured to produce raised or depressed structures within the dimple. In yet another embodiment the dimple arrangement may be based on a polyhedron.

In another embodiment according to the present invention, a golf ball has an outer surface, the outer surface comprises a plurality of dimple structures having an annular conical shaped base with a center including a dimple formed therein. Flat annular land areas are provided around the dimples, the land areas comprising less than 20% of the outer surface.

In yet another embodiment according to the present invention, a golf ball is provided having an outer surface with at least one dimple structure, the dimple structure comprises an annular conical shaped base having a center with a dimple formed therein.

BRIEF DESCRIPTION OF THE DRAWINGS

In the accompanying drawings, which form a part of the specification and are to be read in conjunction therewith, which are given by way of illustration only, and thus are not meant to limit the present invention, and in which like reference numerals are used to indicate like parts in the various views.

DETAILED DESCRIPTION OF THE PREFERRED EMBODIMENTS

Figure 1A:
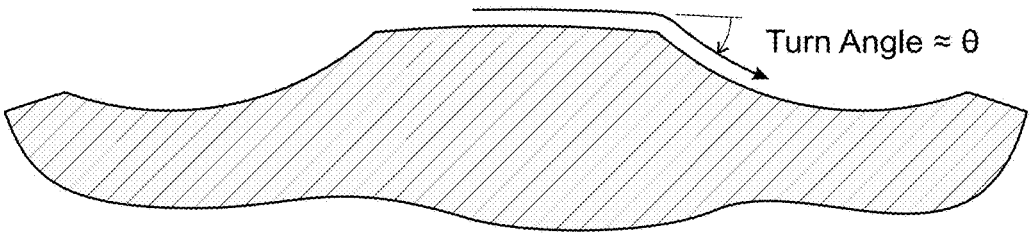
FIG. 1A shows a cross-sectional view of air traveling across a piece of land on the surface of a golf ball before entering a dimple, the turn angle being approximately equal to the dimple's edge angle.
Figure 2A:
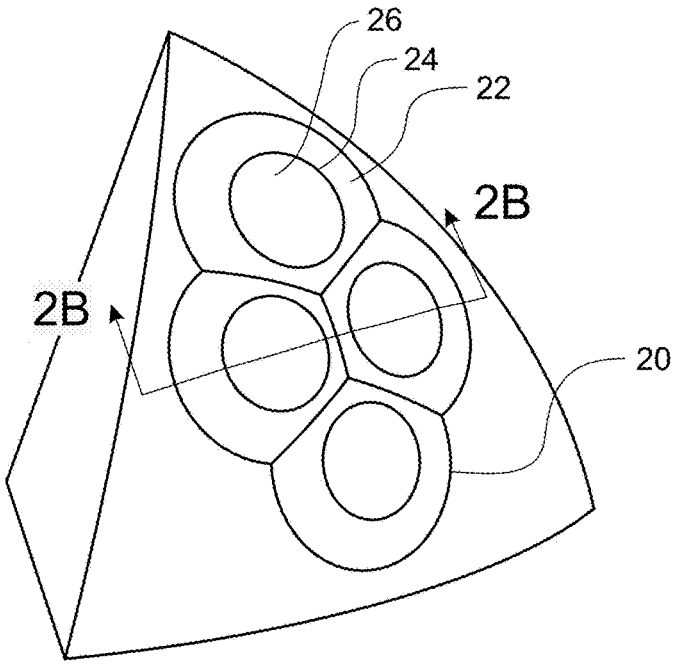
FIG. 2A is a view of a section of the golf ball surface showing an arrangement of four dimple structures of the present invention.
Figure 2B:
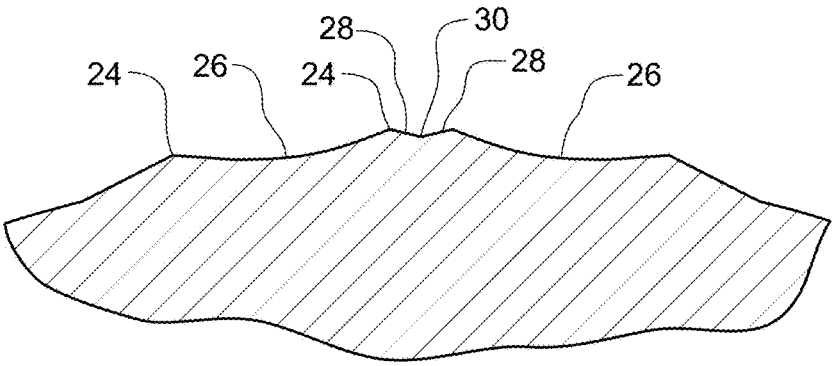
FIG. 2B is a cross-sectional view of the intersection of two dimple structures of the present invention across the section 2B-2B shown in FIG. 2A.

The present invention is best visualized as a collection of dimple structures having volcano shaped bases with dimples as their craters. In one embodiment illustrated in FIG. 2A, four such dimple structures 20 are applied to a section of a golf ball. The dimple structures 20 are preferably circular when viewed from above (in plan view); however, other generally rounded shapes are also contemplated, including elliptical, egg-shaped, rounded polygonal, faceted, or oval shapes. Each dimple structure 20 includes an annular conical shaped base 22, the annular conical shaped base 22 having a top 24 including a dimple 26. As shown in FIGS. 2A-B, when these dimple structures 20 are packed together to form a dimple pattern, sloped sides 28 of adjacent dimple structures 20 cooperate to form valleys 30 in place of the slightly convex land area that separates dimples in conventional golf balls (as shown in FIG. 1A). The valleys 30 are nominally V shaped in cross-section, although other shapes such as U shapes, cusps, or semi-circles are also contemplated. It will be understood that the finish coatings found on most golf balls would modify the nominal shapes by rounding off sharp corners.

It will be appreciated that most or preferably all of the sloped sides 28 of the conical shaped bases 22 are spaced far enough from one another to preserve at least some of the sloped sides 28 around the full perimeter of dimple structure 20.

Figure 1B:
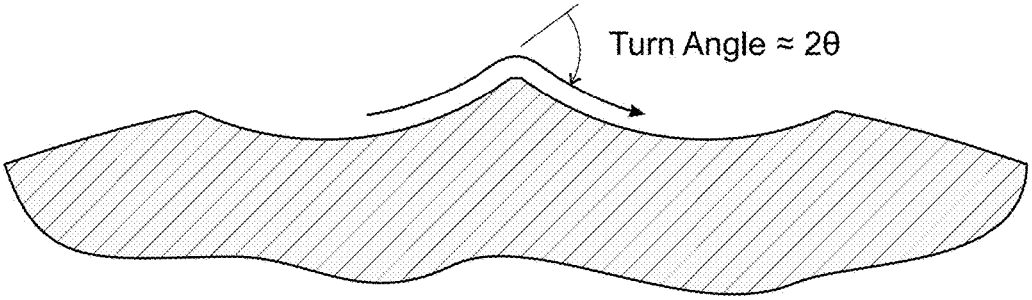
FIG. 1B shows a cross-sectional view of two dimples nearly touching, the air rising out of one dimple and turning directly into the other, the turn angle being approximately twice the dimples' edge angle.
Figure 1C:
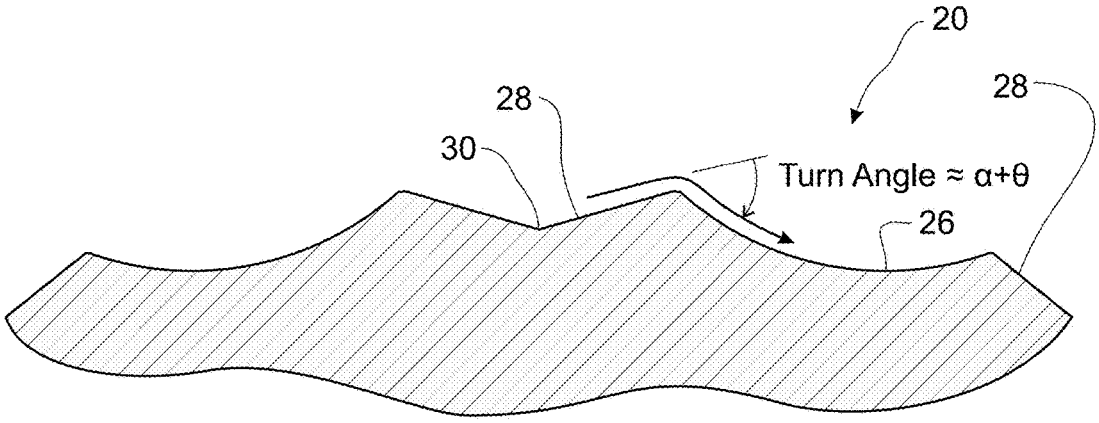
FIG. 1C shows a cross-sectional view of two adjacent dimple structures of the present invention, the air rising along the conical wall surrounding one dimple and turning into the dimple, the turn angle being approximately the sum of the conical wall angle and the dimple edge angle.

It will be appreciated that dimples that are circular or generally circular cannot be tessellated on the surface of a golf ball. As a result, the land areas surrounding circular dimples will never be uniform in width; there will always be areas of narrow land and wide land around the perimeter. This produces an inconsistent airflow situation depending upon the direction from which the flow approaches the dimple. This inconsistency means that it is impossible to create a flow situation that is optimal regardless of flow direction. FIG. 1A shows the situation when the air passes over a relatively wide land area before reaching the dimple. When reaching the dimple, the flow encounters a turn angle about equal to the dimple's edge angle θ. The magnitude of the turn angle affects the way the dimple produces turbulence, which is the foundation of effective golf ball aerodynamic design. FIG. 1B shows the situation when the land area is relatively narrow. Since the airflow is traveling directly from the upslope of one dimple onto the downslope of the next dimple, in effect the turn angle is about twice the dimple edge angle θ. This produces a different aerodynamic effect than the situation of FIG. 1A. In contrast, FIG. 1C shows the situation for an adjacent pair of the dimple structures of the present invention. Regardless of the spacing between dimples, each dimple 26 is surrounded by at least some of the sloped side 28 of the conical shaped base 22. The sloped sides 28 of adjacent structures cooperate to form valleys 30. Regardless of direction, the flow must emerge from the valley 30 along the sloped side 28, and turn into the dimple, encountering a turn angle of about α+θ. Thus, the situation is similar for all flow directions, allowing an optimal design that works for all flow directions.

Figure 1D:
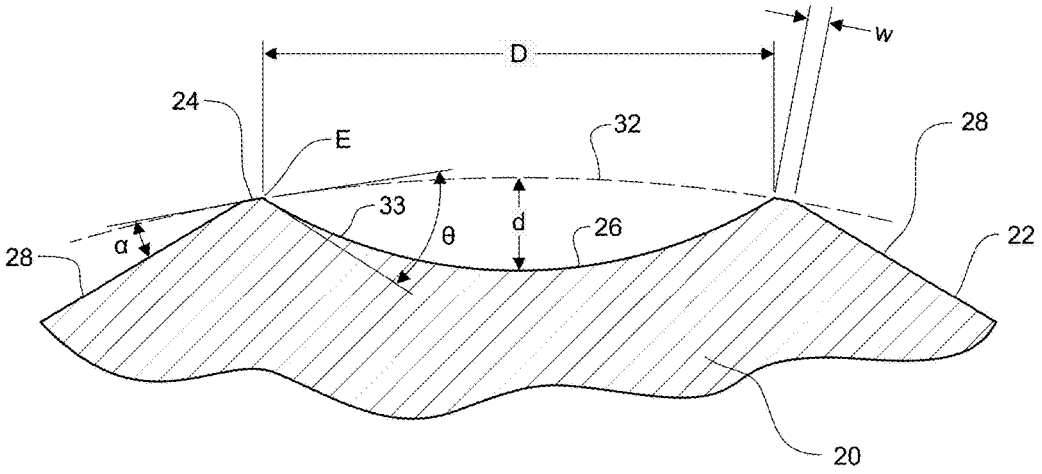
FIG. 1D shows a cross-sectional view of a dimple structure according to the present invention.

Referring now to FIG. 1D a cross-sectional view taken through the center of one of the dimple structures 20 of the present invention is shown, and defines several parameters which are used to characterize the geometry of the dimple structures 20. This view represents the dimple structure 20 prior to application of paint or other finish coats which commonly exist on finished golf balls. It will be understood that the parameters are defined and measured in this unfinished state. The sloped sides 28 of the conical base 22 form a wall angle α with the phantom surface 32 of the ball. This angle is measured between the sloped side 28 and a tangent to the phantom surface 32 at the point where the sloped side 28 intersects the phantom surface 32. If the sloped side 28 does not form a straight line, then a tangent to the sloped side 28 is constructed at the same intersection point and the wall angle α is measured between the two tangents. The top 24 of the structure includes a dimple 26 that forms an edge angle θ with the phantom surface 32. This angle is measured between a tangent to the phantom surface 32 and a tangent to the dimple wall 33, both constructed at the dimple edge E, which is the point where the dimple wall 33 intersects the phantom surface 32. It will be understood that when determining intersection points between the structure and the phantom surface 32, the sloped side 28 and/or the dimple wall 33 may have a slight radius where it intersects the phantom surface 32, making the intersection point somewhat indistinct. In this case, the intersection point is constructed by extending the sloped side 28 and/or the dimple wall along a tangent straight path until it intersects the phantom surface 32. The diameter D of the dimple 26 is measured along a straight line between diametrically opposed edges E. The depth d of the dimple 26 is the maximum distance between the dimple surface and the phantom surface 32, measured along a path that intersects the center of the golf ball. The top 24 of the dimple structure 20 may coincide with the phantom surface 32 for a finite length, in which case its width w is measured along a straight line between the dimple edge E and the point where the sloped side 28 intersects the phantom surface 32.

In cases where the dimple structure 20 and/or the dimple 26 are not strictly circular, the dimple is replaced by a surrogate spherical dimple having a diameter D such that it intercepts the same amount of area of the phantom surface 32, and having the same depth d. The dimple structure 20 is replaced by a surrogate circular (i.e., axisymmetric) structure having the same average top width w and the same average wall angle α. Measurements are then performed on the surrogate dimple and structure.

Dimples 26 provided in the dimple structures 20 according to the present invention preferably have a dimple diameter D within a range having a lower limit of 0.060 inches or 0.075 inches or 0.090 inches or 0.105 inches or 0.120 inches or 0.135 inches and an upper limit of 0.340 inches or 0.300 inches or 0.260 inches or 0.220 inches or 0.180 inches. As shown, the cross-sectional shape of the dimple 26 is a circular arc, producing a spherical depression. It will be appreciated that the cross-sectional shape may take on many forms, including but not limited to parabolic, elliptical, catenary, V shaped, truncated V shaped, or compound arc. It may also be configured to produce one or more raised or depressed structures within the dimple 26.

Figure 3A:
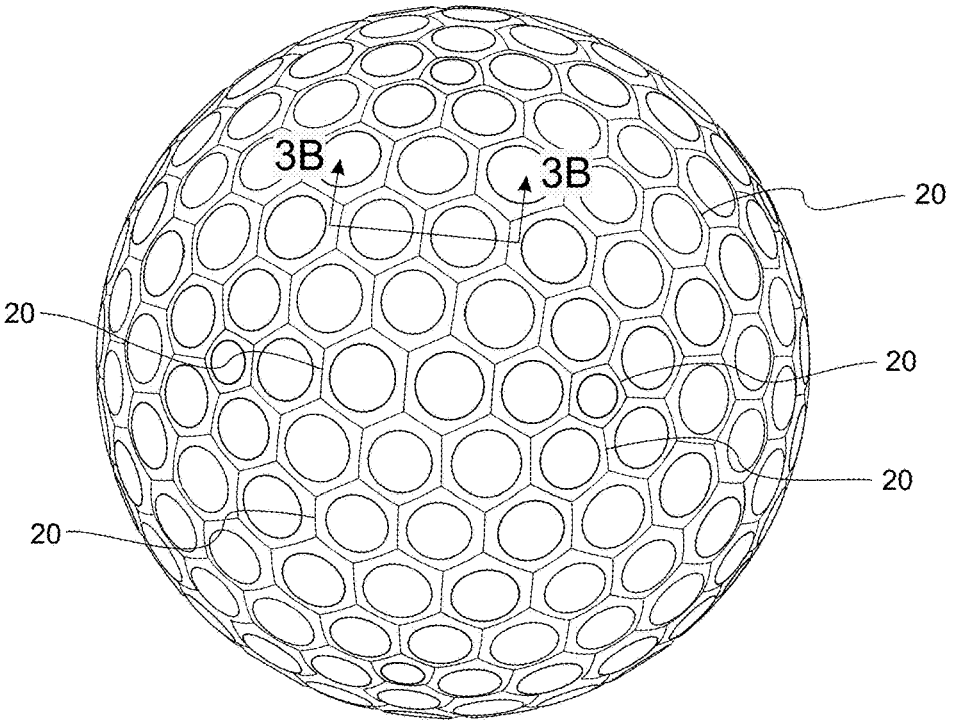
FIG. 3A shows a golf ball with a 252 dimple icosahedral layout of the dimple structure according to the present invention, the dimple structures having conical sides and a spherical depression.
Figure 3B:
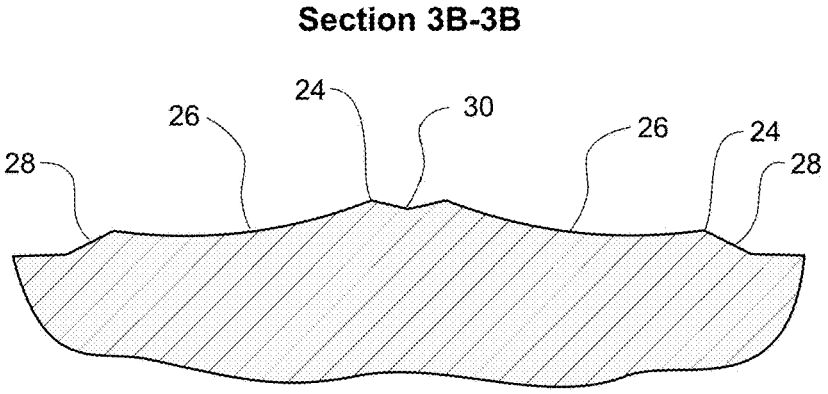
FIG. 3B is a cross-sectional view of the intersection of two dimples structures of the present invention across the section 3B-3B shown in FIG. 3A.

Another embodiment of the present invention is illustrated in FIG. 3A. FIG. 3A shows a completed dimple configuration using 252 dimple structures 20 like those of FIG. 2A. The sloped sides 28 of the base 22 are conical in shape, and the dimples 26 are spherical depressions. As is known in the art, the land area of structures on a phantom surface 32 (see FIG. 1D) of the ball can be estimated. In this embodiment of the present invention, the tops 24 of the conical bases 22 are narrow ridges having essentially zero width, so they occupy essentially 0% of the phantom surface 32 of the ball. The dimple diameters D range from about 0.100 inches to about 0.165 inches with an edge angle θ of preferably 5° to 15°. The wall angle α of the sloped sides 28 is preferably 15° to 25°.

Figure 4A:
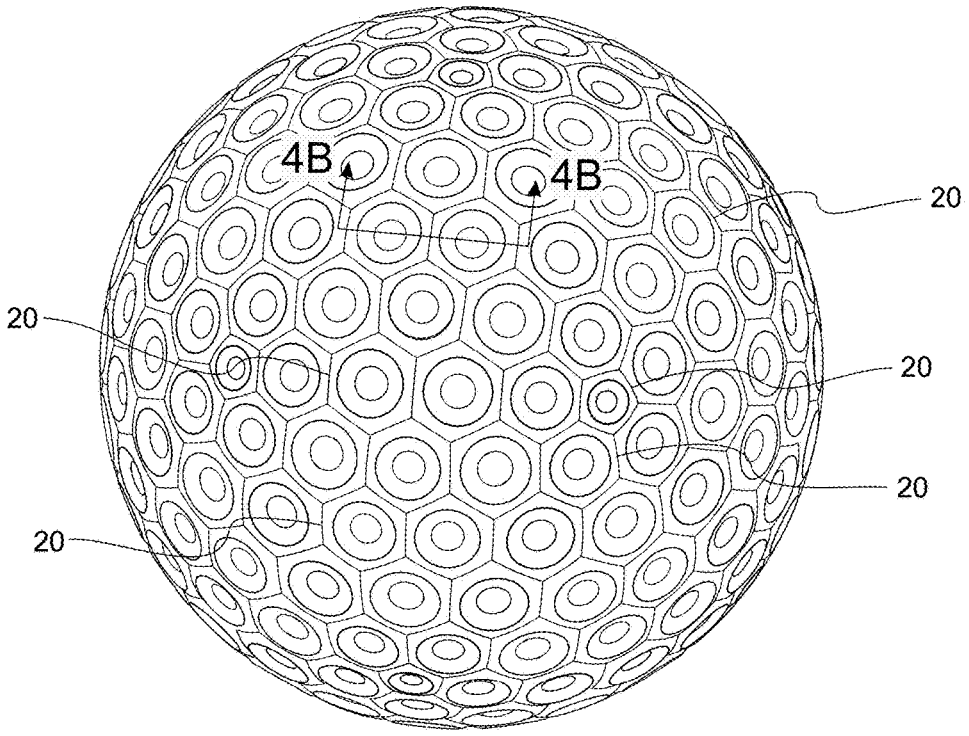
FIG. 4A shows a golf ball with a 252 dimple icosahedral layout of the dimple structures according to the present invention, the dimple structures having conical sides and a truncated cone depression.
Figure 4B:
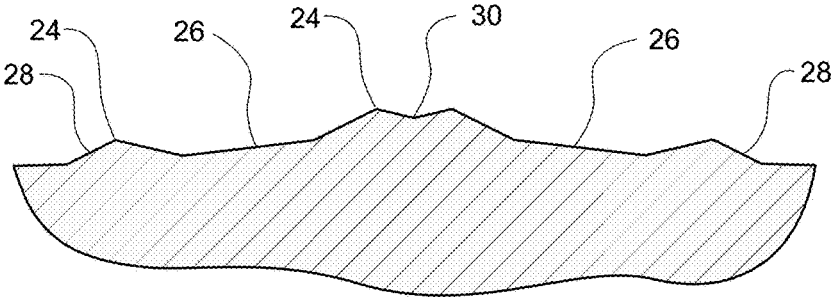
FIG. 4B is a cross-sectional view of the intersection of two dimples structures of the present invention across the section 4B-4B shown in FIG. 4A.

In another embodiment as illustrated in FIG. 4A, the dimple configuration uses 252 dimple structures 20 like those of FIG. 2A. As illustrated more clearly in FIG. 4B, the sloped sides 28 of the base 22 are conical in shape, and the dimples 26 have a truncated V shaped profile, producing truncated cone dimples. In this embodiment of the present invention, the tops 24 of the conical bases 22 are narrow ridges having essentially zero width, so they occupy essentially 0% of the phantom surface 32 of the ball. The dimple diameters D range from about 0.100 inches to about 0.165 inches with an edge angle θ of preferably 5° to 15°. The wall angle α of the sloped sides 28 is preferably 15° to 25°.

Figure 5A:
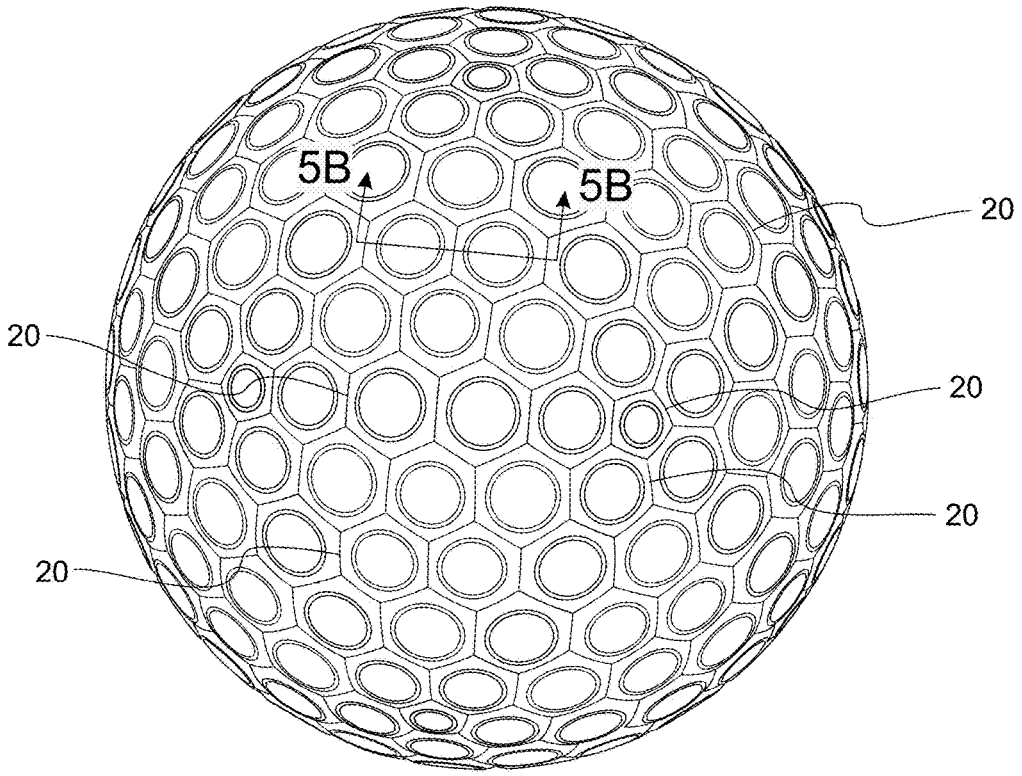
FIG. 5A shows a golf ball with a 252 dimple icosahedral layout of the dimple structures according to the present invention, the dimple structures having conical sides and a saucer shaped depression.
Figure 5B:
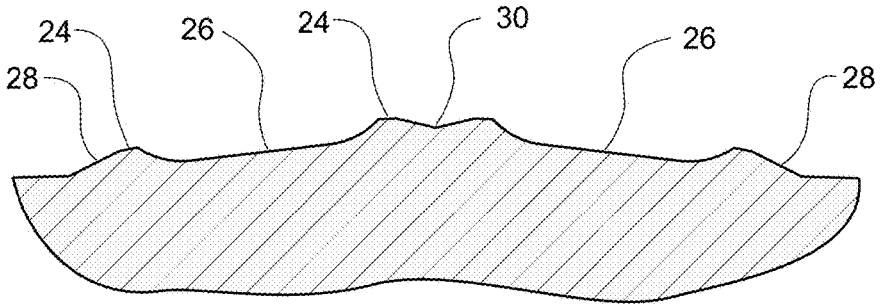
FIG. 5B is a cross-sectional view of the intersection of two dimples structures of the present invention across the section 5B-5B shown in FIG. 5A.

As illustrated in FIG. 5A, another dimple configuration uses 252 dimple structures 20 like those of FIG. 2A. As illustrated more clearly in FIG. 5B, the sloped sides 28 of the base 22 are conical in shape, and the dimples 26 have profiles made up of tangential compound arcs (with a smaller radius of curvature near the edges and a larger radius of curvature near the center), producing saucer shaped dimples. In this embodiment of the present invention, the tops 24 of the conical bases 22 are coincident with the phantom surface 32 for a width w of about 0.010 inches, occupying about 2% of the phantom surface 32 of the ball. The dimple diameters D range from about 0.085 inches to about 0.145 inches with an edge angle θ of preferably 5° to 15°. The wall angle α of the sloped sides 28 is preferably 15° to 25°.

Figure 6A:
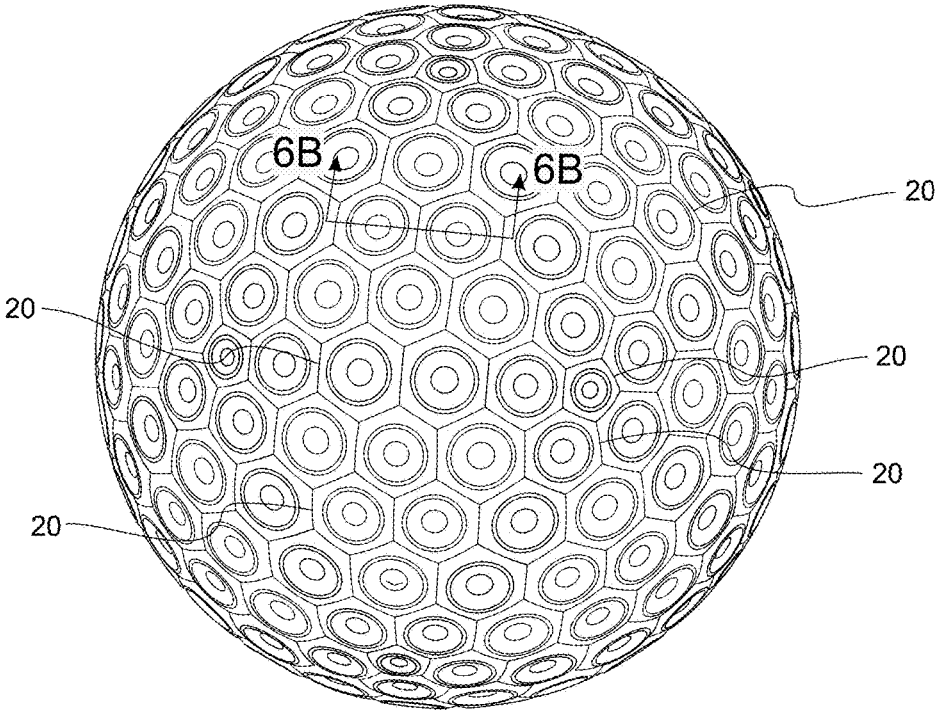
FIG. 6A shows a golf ball with a 252 dimple icosahedral layout of the dimple structures according to the present invention, the dimple structures having conical sides and a dimple-in-dimple depression.
Figure 6B:
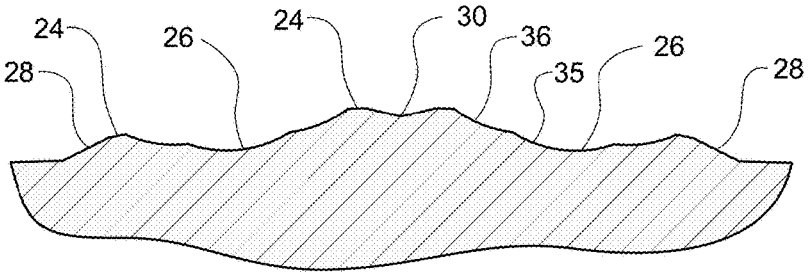
FIG. 6B is a cross-sectional view of the intersection of two dimples structures of the present invention across the section 6B-6B shown in FIG. 6A.

In another embodiment illustrated in FIG. 6A, the dimple configuration uses 252 dimple structures 20 like those of FIG. 2A. As illustrated more clearly in FIG. 6B, the sloped sides 28 of the base 22 are conical in shape, and the dimples 26 have profiles made up of non-tangential compound arcs, producing dimple-in-dimple shapes having a second dimple 35 formed within a first dimple 37. In this embodiment of the present invention, the tops 24 of the conical bases 22 are coincident with the phantom surface 32 for a width w of about 0.010 inches, occupying about 2% of the phantom surface 32 of the ball. The dimple diameters D range from about 0.085 inches to about 0.145 inches with an edge angle θ of preferably 5° to 15°. The wall angle α of the sloped sides 28 is preferably 15° to 25°.

Figure 7A:
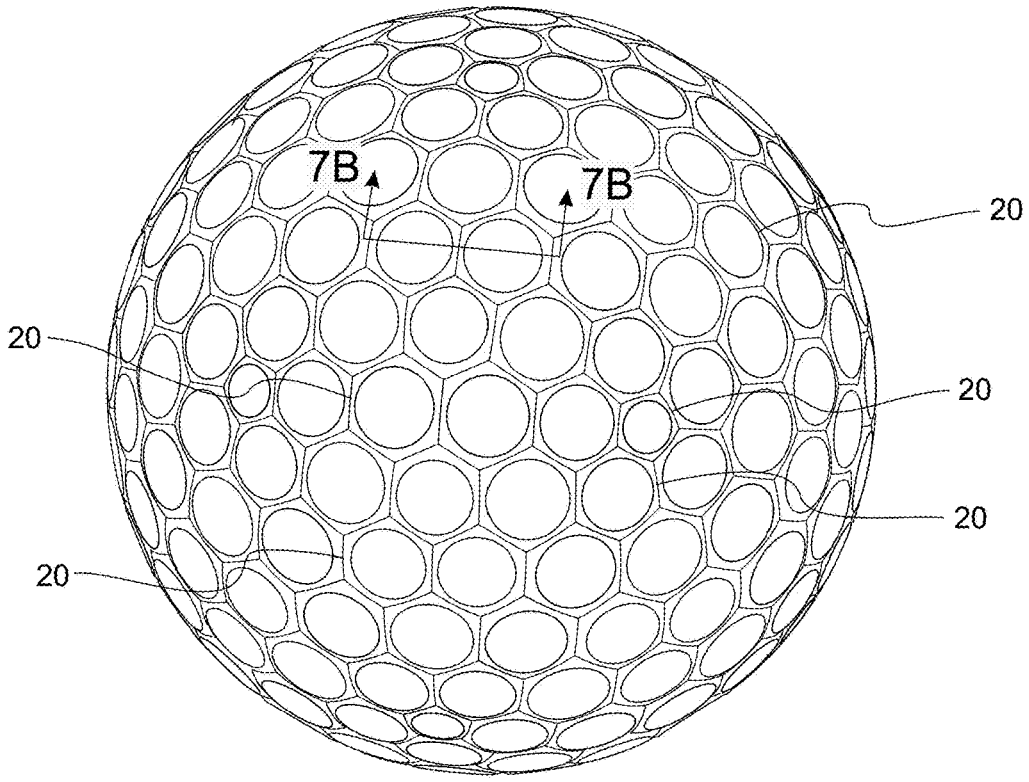
FIG. 7A shows a golf ball with a 252 dimple icosahedral layout of the dimple structures according to the present invention, the dimple structures having conical sides and a conical depression.
Figure 7B:
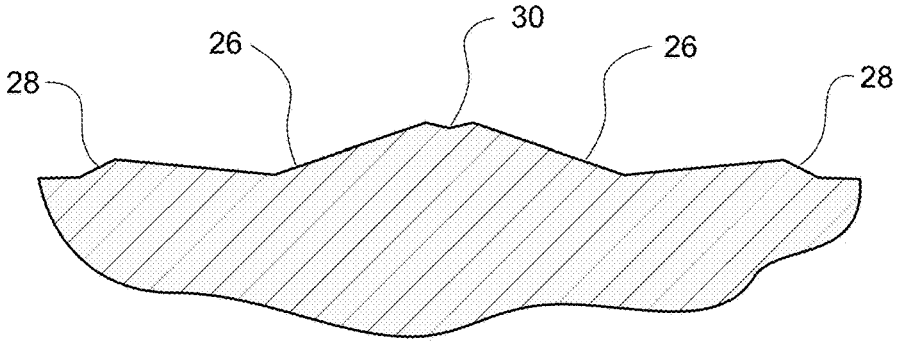
FIG. 7B is a cross-sectional view of the intersection of two dimples structures of the present invention across the section 7B-7B shown in FIG. 7A.

As illustrated in FIG. 7A, another dimple configuration uses 252 dimple structures 20 like those of FIG. 2A. As shown in FIG. 7B, the sloped sides 28 of the base 22 are conical in shape, and the dimples 26 have a V shaped profile, producing cone shaped dimples. In this embodiment of the present invention, the tops 24 of the conical bases 22 are narrow ridges having essentially zero width, so they occupy essentially 0% of the phantom surface 32 of the ball. The dimple diameters D range from about 0.117 inches to about 0.185 inches with an edge angle θ of preferably 5° to 15°. The wall angle α of the sloped sides 28 is preferably 15° to 25°.

It will be appreciated that the cross-sectional shape of the dimple 26 is not particularly limited. In additional to the examples shown in FIGS. 3A-7B, further examples of dimple 26 cross-sectional shape include parabolic, elliptical, catenary and other shapes including those configured to produce raised structures within the dimple 26.

In order to provide sufficient space between the dimples to accommodate the valleys 30, the dimples 26 of the present invention are typically made smaller than the dimples of conventional configurations having the same number of dimples. To prevent the dimples 26 from becoming too small to be effective aerodynamically, it is preferred to use a relatively small number of dimple structures 20 to form the overall dimple pattern on the golf ball. While most prior art golf balls employ from about 250 to about 450 dimples, the preferred number for the present invention is in the range from about 90 to about 400, more preferably from 90 to 300. More particularly, golf balls of the present invention typically have a dimple count within a limit having a lower limit of 90 and an upper limit of 150 or 200 or 250 or 300 or 350 or 400. In a particular embodiment, the dimple count is 90 or 252 or 272 or 302 or 312 or 320 or 332 or 336 or 340 or 352 or 360 or 362 or 364 or 372 or 376 or 384 or 390 or 392. At the lower end of this range, the dimple 26 can become large enough to significantly reduce the sphericity of the golf ball, causing it to rebound off the clubface in unpredictable directions, especially at lower impact levels, and reducing the trueness of the roll on the putting green. To solve this problem, it is preferable to provide a raised structure within the dimple 26 that reaches a height approximately coincident with the phantom spherical ball 32 at that point. This structure can provide a secondary benefit of additional surface contours to improve the aerodynamic effect of the dimple 26.

Figure 8A:
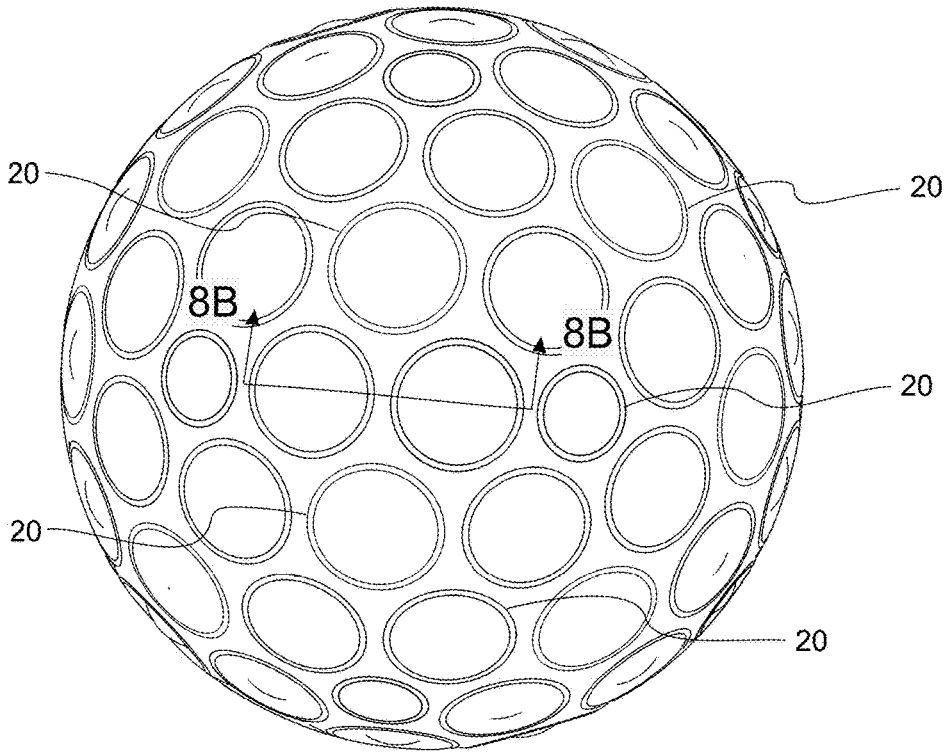
FIG. 8A shows a golf ball with a 92 dimple icosahedral layout of the dimple structures according to the present invention, the dimple structures having conical sides and a bramble-in-dimple depression.
Figure 8B:
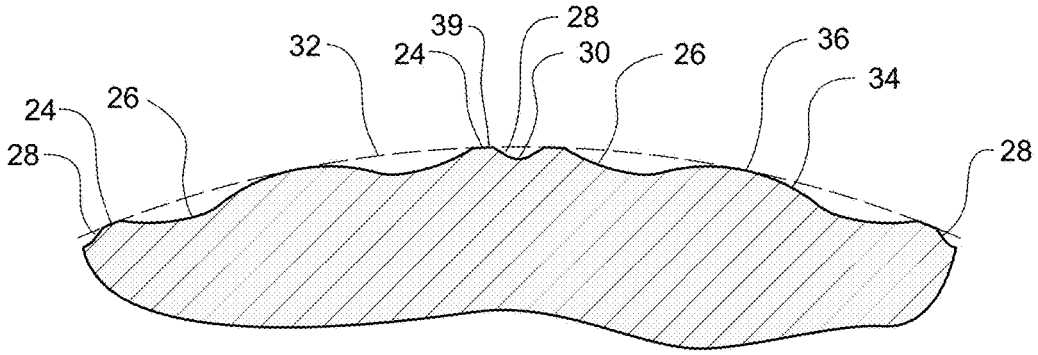
FIG. 8B is a cross-sectional view of the intersection of two dimples structures of the present invention across the section 8B-8B shown in FIG. 8A.

FIG. 8A illustrates another dimple configuration comprising a total of just 92 dimple structures 20 that use a raised dimple structure within the dimple 26. Once again, the dimple structures 20 feature an annular conical base 22, the base 22 further comprising a dimple 26 in the center. As shown in FIG. 8B, the sloped sides 28 of adjacent structures cooperate to form V shaped valleys 30, but in this case the bases of the valleys 30 are rounded. Since the dimples 26 at the tops of these structures are very large, each one has been provided with a dome shaped raised structure 34 at its center. A top 36 of these raised structures 34 coincide with the phantom spherical surface 32 of the ball, as shown in cross-section in FIG. 8B. Annular rings 39 of land area provided at the tops 24 of the conical bases 22 amount to 2.3% of the phantom surface 32 of the ball. Since the top 36 of the raised structures 34 have essentially point contact with the phantom surface 32, they contribute essentially nothing to this number. The dimple diameters D range from about 0.190 inches to about 0.285 inches with an edge angle θ of preferably 5° to 15°. The wall angle α of the sloped sides 28 is preferably 15° to 25°.

Figure 9A:
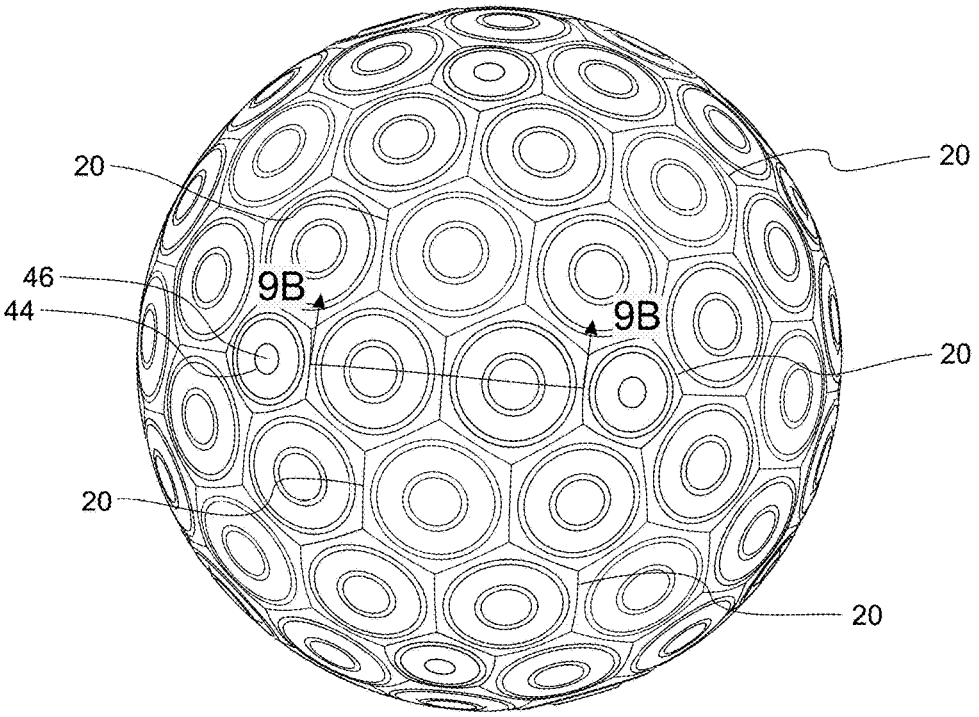
FIG. 9A shows a golf ball with a 92 dimple icosahedral layout of the dimple structures according to the present invention, the dimple structures having conical sides and a depression with a raised annular ring inside the depression.
Figure 9B:
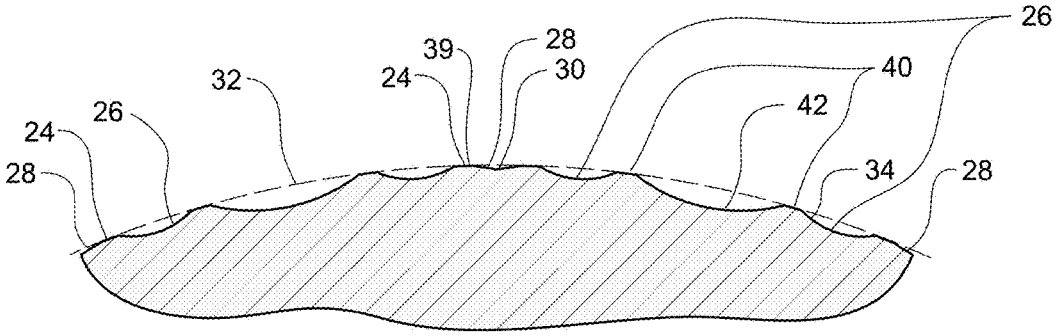
FIG. 9B is a cross-sectional view of the intersection of two dimples structures of the present invention across the section 9B-9B shown in FIG. 9A.

FIG. 9A shows another dimple layout configuration with a total of 92 dimple structures 20. Referring to FIG. 9B, the dimple structures 20 feature sloped sides 28 of the annular conical base 22, the base 22 further comprising a dimple 26 in the center. In the larger dimples of this example, the raised structure 34 takes the form of a ring 40. In effect, the ring 40 delineates a second smaller dimple 42 within the large dimple 26. In the smallest dimple of this example, the raised structure 34 takes the form of a raised circular plateau 44, a top surface 46 of which coincides with the ball's phantom spherical surface 32. The annular rings 39 of land area provided by the tops 24 of the conical bases 22, the rings 40 of the raised structures 34 and the top surfaces 46 of the circular plateaus 44 amount to 3.3% of the phantom surface 32 of the ball. The dimple diameters D range from about 0.190 inches to about 0.285 inches with an edge angle θ of preferably 5° to 15°. The wall angle α of the sloped sides 28 is preferably 15° to 25°.

Figure 10A:
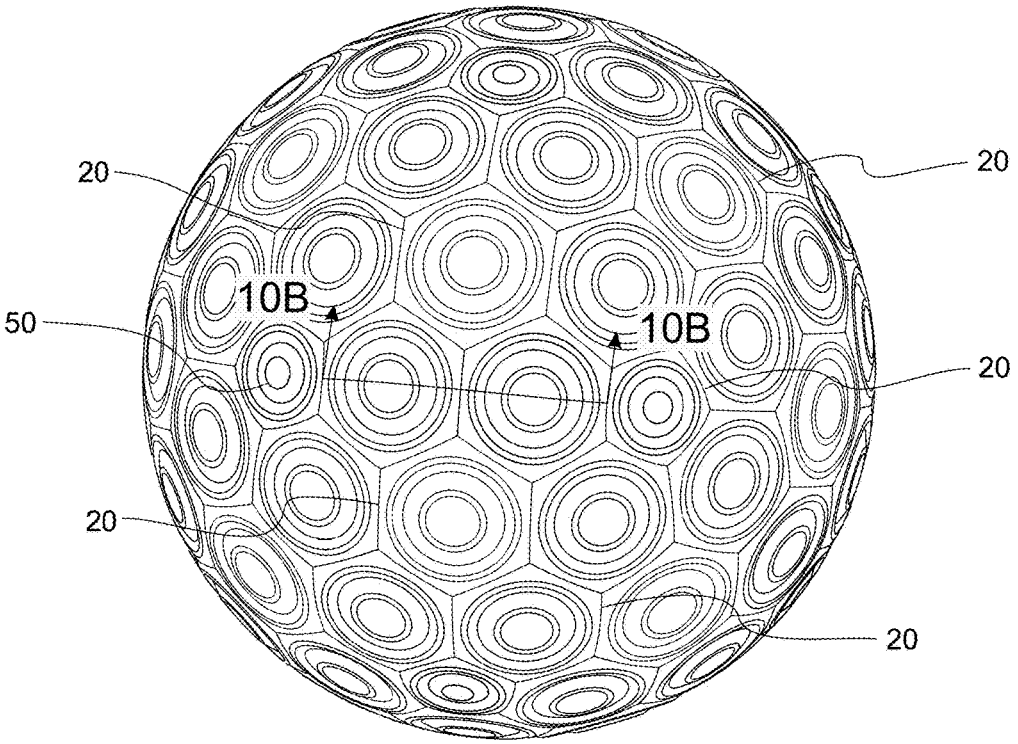
FIG. 10A shows a golf ball with a 92 dimple icosahedral layout of the dimple structures according to the present invention, the dimple structures having conical sides and a conical depression with a raised annular ring with conical sides inside the conical depression.
Figure 10B:
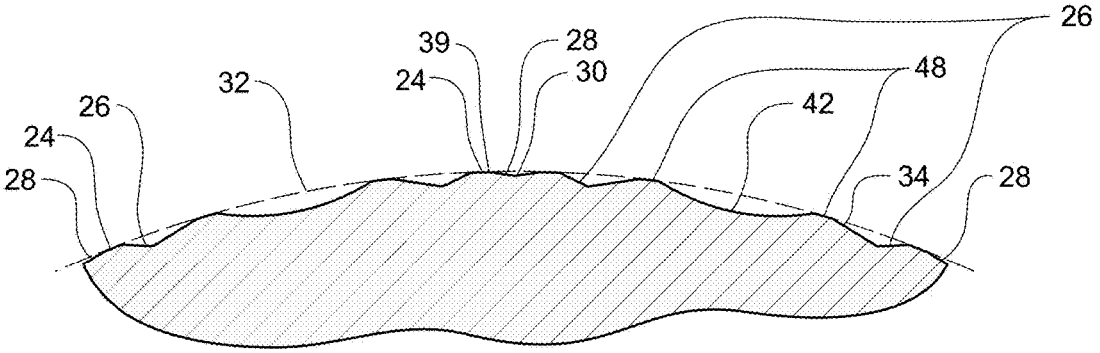
FIG. 10B is a cross-sectional view of the intersection of two dimples structures of the present invention across the section 10B-10B shown in FIG. 10A.

FIG. 10A shows another dimple layout configuration with a total of 92 dimple structures 20. As shown in FIG. 10B, the dimple structures 20 feature sloped sides 28 of the annular conical base 22, the base 22 further comprising a dimple 26 in the center. In this embodiment, the raised structures 34 within the larger dimples 26 are secondary smaller volcano shaped structures 48. The smallest dimples do not have sufficient room for secondary volcano shaped structures, so in those dimple structures 20 the raised structure 34 is a circular plateau 50 similar to the ones in FIGS. 9A-9B. The annular rings 39 of land area provided by the tops 24 of the conical bases 22, volcano shaped structures 48 and circular plateaus 50 amount to 3.3% of the phantom surface 32 of the ball. The dimple diameters D range from about 0.190 inches to about 0.285 inches with an edge angle θ of preferably 5° to 15°. The wall angle α of the sloped sides 28 is preferably 15° to 25°.

Figure 11A:
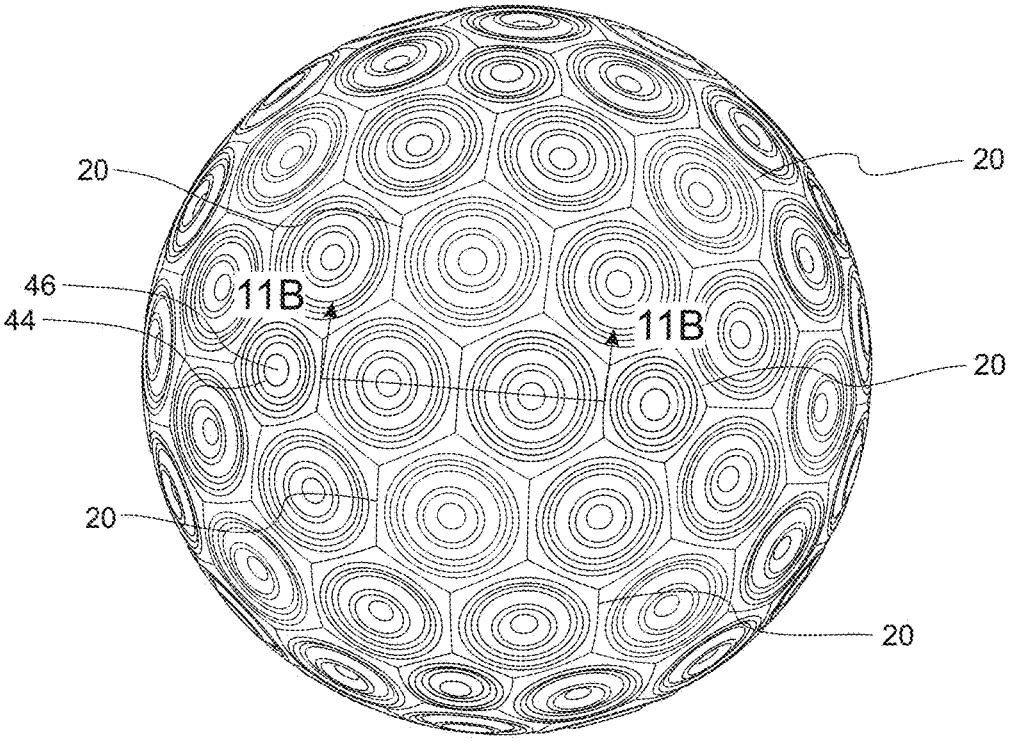
FIG. 11A shows a golf ball with a 92 dimple icosahedral layout of the dimple structures according to the present invention, the dimple structures having conical sides and a truncated conical depression with a raised annular ring with conical sides inside the truncated cone depression.
Figure 11B:
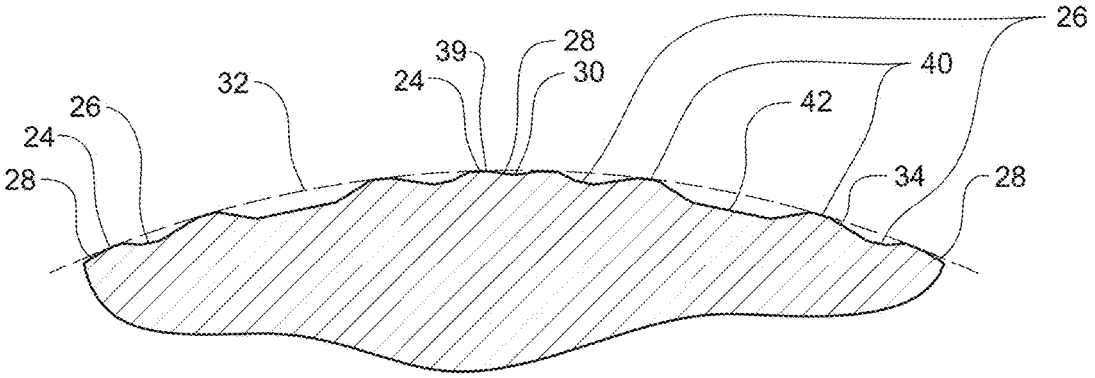
FIG. 11B is a cross-sectional view of the intersection of two dimples structures of the present invention across the section 11B-11B shown in FIG. 11A.

Finally, FIG. 11A shows a dimple layout configuration similar to FIGS. 9A-9B with a total of 92 dimple structures 20. As illustrated in FIG. 11B, the dimple structures 20 feature sloped sides 28 of the annular conical base 22, the base 22 further comprising a dimple 26 in the center. In this embodiment the dimples 26 take the form of truncated cone shaped depressions rather than spherical depressions. In the larger dimples of this example, the raised structure 34 takes the form of a ring 40. In effect, the ring 40 delineates a second smaller truncated cone dimple 42 within the large dimple 26. In the smallest dimple of this example, the raised structure 34 takes the form of a raised circular plateau 44, a top surface 46 of which coincides with the ball's phantom spherical surface 32. The annular rings 39 of land area provided by the tops 24 of the conical bases 22, the rings 40 of the raised structures 34 and the top surfaces 46 of the circular plateaus 44 amount to 3.3% of the phantom surface 32 of the ball. The dimple diameters D range from about 0.190 inches to about 0.285 inches with an edge angle θ of preferably 5° to 15°. The wall angle α of the sloped sides 28 is preferably 15° to 25°.

While both the 92 and 252 dimple arrangements described above are based on the geometry of an icosahedron as is well known in the art, the present invention is not limited to any particular dimple pattern. The present invention applies equally well to arrangements based on other polyhedra such as octahedra, dodecahedra, cuboctahedra or dipyramids, or to non-polyhedron based arrangement schemes such as phyllotaxis or random arrangements. Examples of suitable dimple patterns include, but are not limited to, phyllotaxis-based patterns; polyhedron-based patterns; and patterns based on multiple copies of one or more irregular domain(s) as disclosed in U.S. Pat. No. 8,029,388, the entire disclosure of which is hereby incorporated herein by reference; and particularly dimple patterns suitable for packing dimples on seamless golf balls. Non-limiting examples of suitable dimple patterns are further disclosed in U.S. Pat. Nos. 7,927,234, 7,887,439, 7,503,856, 7,258,632, 7,179,178, 6,969,327, 6,702,696, 6,699,143, 6,533,684, 6,338,684, 5,842,937, 5,562,552, 5,575,477, 5,957,787, 5,249,804, 5,060,953, 4,960,283, and 4,925,193, and U.S. Patent Application Publication Nos. 2011/0021292, 2011/0165968, and 2011/0183778, the entire disclosures of which are hereby incorporated herein by reference. Non-limiting examples of seamless golf balls and methods of producing such are further disclosed, for example, in U.S. Pat. Nos. 6,849,007 and 7,422,529, the entire disclosures of which are hereby incorporated herein by reference. Thus, it is understood that the inventive feature is not the particular arrangement of the dimple structures 20 on the surface of the ball, but rather in the shape itself and the network of valleys 30 that are formed between them when they are arranged in close proximity to one another. It will be appreciated that one or more dimple structures 20 may be incorporated into any dimple pattern.

It will be appreciated that the dimple arrangements of the present invention may comprise one or more dimple 26 types, diameters, or depths to achieve the desired surface coverage, aerodynamic properties and spherical symmetry.

The dimple structure 20 shapes of the present invention, and particularly the V shaped valley 30 between dimples structures 20, make these novel dimples structures 20 very suitable for use with non-planar parting lines, which are used to improve the aerodynamic symmetry of the ball as well as to visually disguise the parting line on the ball. In this instance, the parting line of the dimple structure 20 forming mold would follow the bottoms of the V shaped valleys 30 that lie on or across the golf ball equator. Although this would make it difficult to abrasively remove (buff) flash from the parting line, it may also eliminate the need to buff since any remnants of flash will be hidden in the bottoms of the valleys 30.

In one embodiment there are essentially no flat land areas on the surface of the ball. However, it will be appreciated that in another embodiment up to 20% of the golf ball's surface area may comprise flat land areas or the tops 24 that coincide with the phantom surface 32 of the golf ball (as shown in FIG. 1D). It is preferable that between about 0 to about 10% of the golf ball's surface may comprise these flat land areas 24, and more preferably that between about 0 to about 5% of the golf ball's surface may comprise these flat land areas. It is further contemplated that flat land areas may be increased to improve durability of the golf ball during play.

Additionally, flight symmetry may be affected by altering a plurality of the novel dimple structures 20 in such a way as to make them more aerodynamically aggressive, such as by altering the dimples 26 by means of a steeper edge angle, greater volume, or adding sub-dimples, i.e. dimples within a dimple. Such modifications further agitate or energize the local turbulent flow over the dimples, balancing out the effects caused by asymmetry in the dimple pattern or by buffing of the dimples in the equator region. Further discussion of the aerodynamic advantages of sub-dimples can be found in U.S. Pat. No. 6,569,038, which is incorporated herein by reference in its entirety. Moreover, flight symmetry may be affected by altering a plurality of the novel dimple structures 20 in such a way as to make them less aerodynamically aggressive, such as by means of less steep edge angle or smaller volume. Such modifications can also balance out the effects caused by asymmetry in the dimple pattern.

The novel shaped dimple structures 20 of the present invention can be used with any type of golf ball with any playing characteristics. The present invention is not limited by any particular golf ball construction or any particular composition for forming the golf ball layers. For example, dimple structures 20 of the present invention can be used to form dimple patterns on one-piece, two-piece (i.e., a core and a cover), multi-layer (i.e., a core of one or more layers and a cover of one or more layers), and wound golf balls, having a variety of core structures, intermediate layers, covers, and coatings. The cores of solid balls are generally formed of a polybutadiene composition. These core materials may include organosulfur or antioxidants, and may be uniform in cross-sectional hardness or may have a gradient in hardness across the cross-section. Alternatively, one or more core layers may comprise a highly neutralized polymer (HNP). In addition to one-piece cores, solid cores can also contain a number of layers, such as in a dual core golf ball. Golf ball cover layers generally comprise ionomer resins, ionomer blends, non-ionomeric thermoplastics, HNP's, grafted or non-grafted metallocene catalyzed polyolefins, thermoplastic polyurethanes, thermoset polyureas or polyurethanes, castable or RIM polyureas or polyurethanes. The golf ball cover can consist of a single layer or include a plurality of layers and, optionally, at least one intermediate layer disposed about the core.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

We claim:

1. A golf ball comprising an outer surface with at least two dimple structures, the dimple structures having an annular conical shaped base having a center with a dimple formed therein, wherein the annular conical shaped base of the dimples are non-polygonal, the dimples having an edge angle of 5° to 15° and further comprising at least one valley formed by the conical shaped bases of the two dimple structures, and wherein the dimples have a diameter ranging from about 0.060 inches to about 0.340 inches.

2. The golf ball of claim 1, wherein at least one conical shaped base has a wall angle $\alpha$ of 15° to 25°.

3. The golf ball of claim 1, wherein a plan shape of said dimple structures is circular, elliptical, egg-shaped, rounded polygonal, faceted, or oval.

4. The golf ball of claim 1, wherein the dimples feature additional surface contours.

5. The golf ball of claim 4, wherein the additional the surface contours include raised structures within the dimple.

6. The golf ball of claim 1, wherein a cross-sectional shape of the dimples are circular arc, parabolic, elliptical, catenary, V shaped, truncated V shaped, or compound arc, or configured to produce raised or depressed structures within the dimple.

7. The golf ball of claim 1, wherein the valley has a cross-sectional shape selected from the group consisting of V, U, cusps or semi-circles.

8. The golf ball of claim 1, further comprising flat land areas adjacent the dimple structures, wherein the flat land areas comprise less than 20% of the outer surface of the golf ball.

9. The golf ball of claim 8, wherein the flat land areas comprise less than 10% of the outer surface of the golf ball.

10. The golf ball of claim 9, wherein the flat land areas comprise less than 5% of the outer surface of the golf ball.

11. The golf ball of claim 1, wherein the outer surface comprises from 90 to 150 dimples structures.

* * * * *